United States Patent [19]

Lock et al.

[11] 4,225,181

[45] Sep. 30, 1980

[54] KNOCK-DOWN ROCKERS AND THE LIKE

[75] Inventors: Melvin N. Lock, Waban; Achille F. Chiappetta, Medfield, both of Mass.

[73] Assignee: Albert M. Lock & Son, Inc., Boston, Mass.

[21] Appl. No.: 30,743

[22] Filed: Apr. 17, 1979

[51] Int. Cl.[2] ..... A47C 3/02; A47C 7/00

[52] U.S. Cl. ..... 297/258; 297/272; 297/416; 297/440; 297/443

[58] Field of Search ..... 108/90; 248/165; 297/258, 272, 416, 421, 440, 443

[56] References Cited

U.S. PATENT DOCUMENTS

| | | | |
|---|---|---|---|
| 693,197 | 2/1902 | White | 297/258 |
| 1,367,390 | 2/1921 | Hinson | 297/272 X |
| 2,092,441 | 9/1937 | Ciprus | 108/90 X |
| 3,115,367 | 12/1963 | Gariepy | 297/440 |
| 3,727,981 | 4/1973 | Ostroff | 297/440 |

*Primary Examiner*—James C. Mitchell

*Attorney, Agent, or Firm*—James E. Mrose

[57] ABSTRACT

A rugged and stylish wooden chair shippable in compact knock-down form includes separate prefabricated back and arm subassemblies with lower portions proportioned to serve as contour-blended marginal parts of the seat of a seat-leg assembly, the cooperating subassemblies being readily united and fastened together securely and unobtrusively with the aid of laterally-extending dowels and bolts. Major stresses occurring at joining sites are advantageously in shear and are reliably resisted by both the dowels and the bolts, and corner posts for the back are prefabricated as parts of the arm sub-assemblies to realize outstanding structural strength. Rocker runners may be fastened to the lower ends of the seat legs, in a rocking-chair embodiment, and each runner thereof is provided with one leg-socket and fastener opening of elongated form accommodating the somewhat coarse leg-spread tolerances expected for the seat subassemblies.

11 Claims, 9 Drawing Figures

FIG. 4
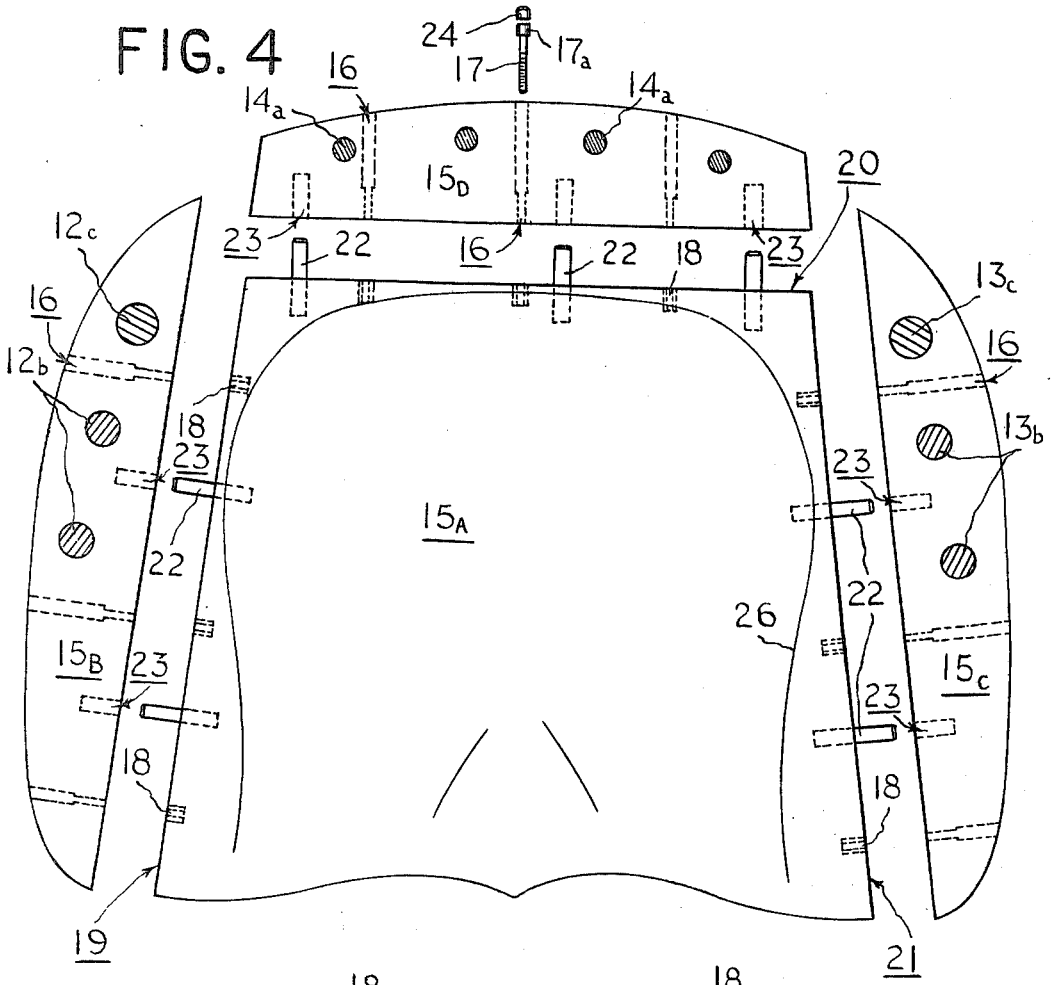
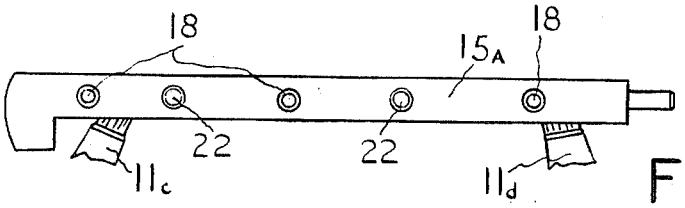
FIG. 7
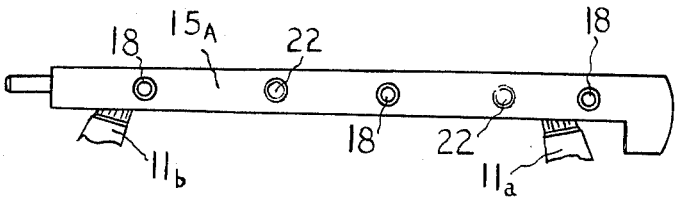
FIG. 8
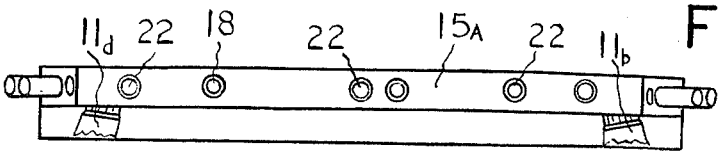
FIG. 9

FIG. 5
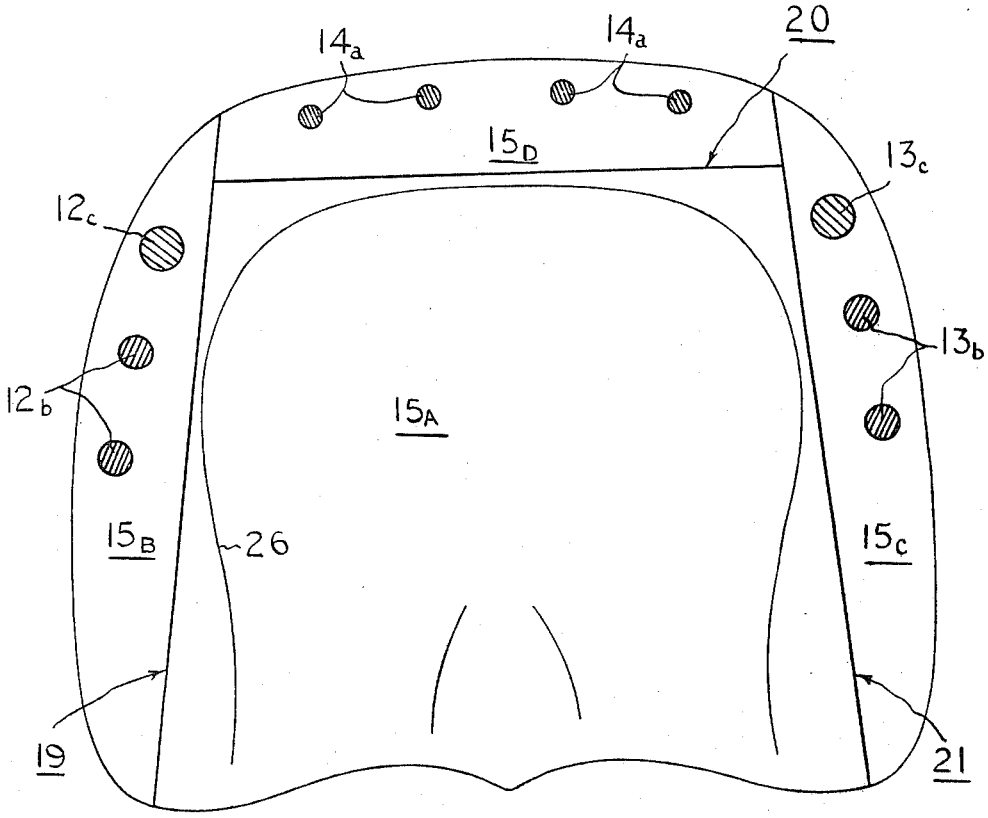
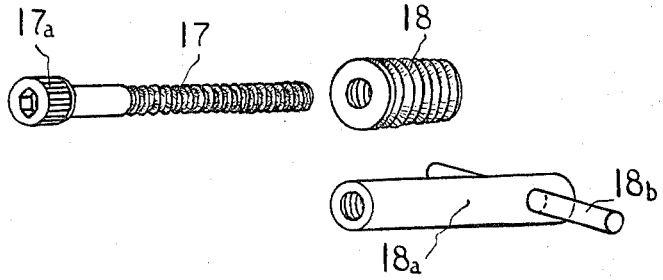
FIG. 6

KNOCK-DOWN ROCKERS AND THE LIKE

BACKGROUND OF THE INVENTION

The present invention relates to improvements in knock-down furniture, and, in one particular aspect, to a unique high-strength wooden chair, such as a rocker, prefabricated by way of a group of sub-assemblies which lend themselves to compact packing for shipment and which are readily united securely to yield a modish article exhibiting seat contouring and other aspects of quality appearance not degraded by its origins as a knock-down item.

It has been well known in the furniture trade to ship various items in disassembled form occupying relatively little volume, with the obvious attendant advantages. However, such practices can result in ungainly and inferior-quality appearance of even rather costly articles which have had to be altered peculiarly to facilitate their packaging in small sections or pieces, with consequent adverse marketing influences. Moreover, at the destination sites, relatively unskilled recipients should be able to assemble the parts quickly and easily, without elaborate tooling or fixtures, and the finished article should be and remain very strong.

By way of example of early knock-down rocking chairs, reference may be had to U.S. Pat. No. 655,488-Hayes, wherein a separate seat is slung between and screw-fastened with back and side posts, and to U.S. Pat. No. 693,197-White, wherein tie rods secure a notched seat and outside legs together, and to U.S. Pat. No. 882,316-Horton, wherein a seat is hooked in place. Legs and rockers are shown as a separate sub-assembly in U.S. Pat. No. 2,716,444-Smith, wherein the seat is a prefabricated part of a seat-arms-back unit, and, in U.S. Pat. No. 3,115,367-Gariepy, a chock-reinforced seat is separately connected with legs. arms and back posts via various fasteners. A cleating approach is described in U.S. Pat. No. 3,727,981-Ostroff et al, and the bulky cleats there disposed atop marginal portions of a seat to hold arm and back units of the chair tend to be concealed when seat cushioning is added.

SUMMARY OF THE INVENTION

The present invention is aimed at creating sturdy knock-down chairs of low-cost construction, and lending themselves to compact packaging for shipment, which nevertheless display lineaments of quality as promoted by visually-pleasing blends of the contours of sub-assemblies specially joined to develop both outstanding strength and agreeable style. In one preferred embodiment of such a chair, as a wooden rocker, a key sub-assembly includes a central contoured seat part lacking the usual full lateral marginal expanses along its sides and rear but having a frame with four depending legs permanently attached near its edges by socketing and glueing. Right and left side sub-assemblies each include arms prefixed with posts socketed into the tops of right and left side seat parts shaped to abut the respective sides of the central seat part and to blend in contour with it and complete the full lateral expanse of the seat. Rear posts of the side sub-assemblies are elongated to function also as major back supports when fastened with opposite sides of a transverse head rail supported by vertical rails rising from a back seat part shaped to abut with the back of the central seat part and with the rear ends of the side seat parts, the back seat part being similarly contoured to blend with the other seat parts and to complete the full rearward expanse of the seat. Along each of the three sites of abutment between the four seat parts which make up the one seat, there are disposed at least two laterally-extending dowels which will fit closely into cooperating openings, such that the central seat part may have each of the side or rear seat parts properly aligned with it and temporarily held in place without other aid while bolts are passed laterally through other openings in the side or rear seat parts and then threadedly tightened into accommodating aligned recesses around the central seat part. The dowels remain hidden in place within the assembled chair and contribute significantly to its structural strength because of their high resistance to the shearing effects into which this unique subassembly arrangement tends to resolve many of the forces experienced in use. Separate rocker runners are each socketed and opened in two places to receive tenons at lower ends of the depending legs and to allow fastening bolts to pass upwardly from below into the legs; however, tolerances in the spreads of the legs are commonly rather coarse, and difficulty in making the needed runner fit is eliminated by oblong shaping of one of the mortise-like runner sockets and its associated bolt hole in each runner, the elongation being in the longitudinal runner direction.

Accordingly, it is one of the objects of the present invention to provide novel and improved known-down chairs including sub-assemblies which interfit uniquely to promote structural strength and to produce stylish blendings of parts such as are appropriate for high-quality furniture.

A further object is to provide a known-down wooden rocker wherein the seat is an aesthetically-blended composite of a central and three marginal parts which are readily interconnected as a foundation for a unique permanently-strong article, and which includes advantageous provisions facilitating assembly.

BRIEF DESCRIPTION OF THE DRAWINGS

Although the aspects of this invention which are considered to be novel are expressed in the appended claims, further details as to preferred practices and as to further objects and features thereof may be most readily comprehended through reference to the following detailed description when taken in connection with the accompanying drawings, wherein:

FIG. 4 is a top plan view of the seat top and margins thereof taken from back and arm sub-assemblies of the FIG. 1 chair, with lateral dowel and bolting provisions being indicated;

FIG. 5 depicts an assembled relationship of parts appearing in FIG. 4;

FIG. 6 represents an Allen-head bolt and both a doubly-threaded nut and a threaded and pinned nut suitable for fastenings of the separate prefabricated sub-assemblies of a chair such as that appearing in FIGS. 1–5;

FIG. 7 views part of the seat sub-assembly of FIG. 1 from the right;

FIG. 8 views part of the same seat sub-assembly of FIG. 1 from the left; and

FIG. 9 views part of the same seat sub-assembly of FIG. 1 from the rear.

DETAILED DESCRIPTION OF THE PREFERRED EMBODIMENTS

Figure 1:
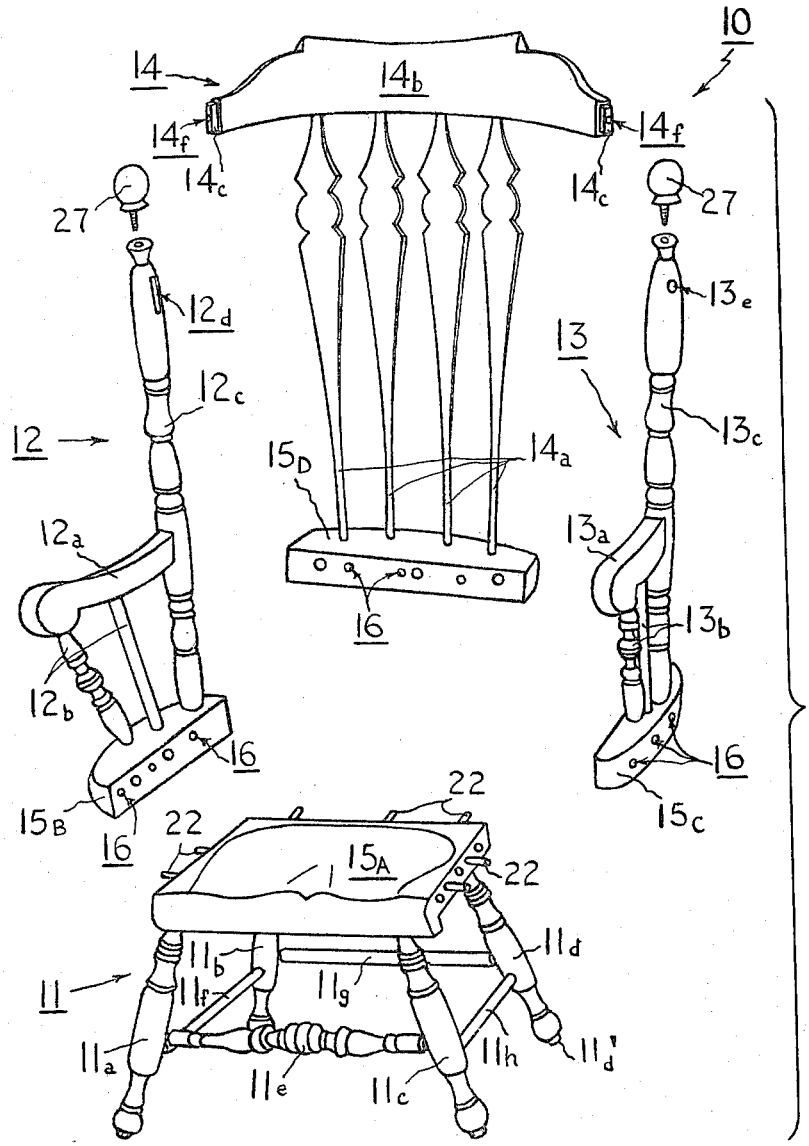
FIG. 1 is a perspective "exploded" view of four prefabricated sub-assemblies which may be joined at margins of the seat to provide an improved knock-down type chair.

Having reference to the drawings, wherein like reference characters designate identical or corresponding parts throughout the different views, and more particularly to FIG. 1 thereof, one embodiment of an improved knock-down wooden chair 10 is expressed by four principal cooperating prefabricated subassemblies, 11–14, all of which include different complementary components of one multi-part seat. Those components include a central seat part, 15A, which lacks side and rear marginal portions needed to complete a stylish lateral expanse for the chair seat, but which is pre-fastened with the four depending legs 11*a*–11*d* and their horizontal bracing rungs 11*e*–11*h*. The two narrow elongated side seat parts, 15B and 15C, are proportioned so that they will abut with central seat part 15A fully along its left and right sides, respectively, and will thereupon complete the lateral side expanses for the seat of the chair. Arm rests 12*a* and 13*a* are fixedly pre-assembled with these side seat parts, on spindles 12*b* and 13*b*, respectively, as well as with the elongated upstanding back posts, 12*c* and 13*c*, which are intended to serve as major structural support elements for the back-reset section of the assembled chair. In the latter connection, and as is discussed further hereinafter, large backwardly-directed loads taken on by these posts will tend to be resisted advantageously in shear by relatively small fasteners and dowels used to secure the side seat parts with the central seat part. If those loads were instead resisted mainly through the slender rear seat part 15D, with the posts rising from there, that seat part would tend to split and the associated fasteners and dowels would experience forces tending to pull them loose. Rear seat part 15D is in a prefabricated mounting relationship with a group of upstanding back supports 14*a*, the latter carrying a transverse head rail 14*b* the ends of which are formed as tenons 14*c* fitting within appropriate mortised openings in the back posts, such as opening 12*d*.

The four sub-assemblies, 11–14, are to be joined together by the user, at a destination point following their shipment in a compactly-packaged relationship in a suitable protective carton. For purposes of such assembly, the three marginal seat parts 15B–15D are provided with transversely-extending bolt holes, designated by reference character 16 in FIGS. 1 and 4, which are large enough in outside recessing to accommodate the enlarged head 17*a* of an elongated threaded bolt 17, preferably of a socket-head type as shown in FIG. 6. Inwardly, holes 16 are of smaller diameter, as shown (FIG. 4), to insure that the bolt heads are trapped securely in the marginal seat parts when they are tightly wrenched into internally-threaded recessed receptacles 18 disposed along the side and rear margins 19, 20 and 21 of the central seat parts at appropriately-aligned positions. Preferably, receptacles 18 are in the form of metal inserts threaded externally as well as internally, as shown in FIG. 6, or in the form of an internally-threaded pin 18*a* (FIG. 6) which is held securely in place by a transversely-extending dowel 18*b*. Assembly, particularly by one person alone, is aided materially by the short pre-set dowels 22 projecting laterally outwardly from the central seat margins and disposed to mate with cooperating blind openings 23 facing those margins from the inner sides of the side and rear seat parts. The assembler need only fit a marginal seat part onto the appropriate set of dowels extending from the central seat part, whereupon it is then held in position for Allen-head bolts, such as 17, to be inserted into holes 16 from the outside and threadedly fastened tightly with the receptacles 18 by use of a simple Allen wrench or the like. Once the assembly has been completed in that fashion, the margins 19, 20 and 21 are scarcely perceptible in a well-made unit, and the hidden dowels 22 help to withstand very large forces in the shear direction which they resist especially well. Openings 16 may be closed from the outside by small plugs 24 (FIG. 4), which will conceal the bolt heads and holes. Bolting is also preferred to augment the tenon-mortise jointing of the head rail $\mathbf{14}_b$ with back posts $\mathbf{12}_c$ and $\mathbf{13}_c$, as accommodated by bolt openings such as $\mathbf{13}_e$ and $\mathbf{14}_f$ (FIG. 1); the bolts and their receptacles and covering plugs may be like items 17, 18 and 24.

Figure 2:
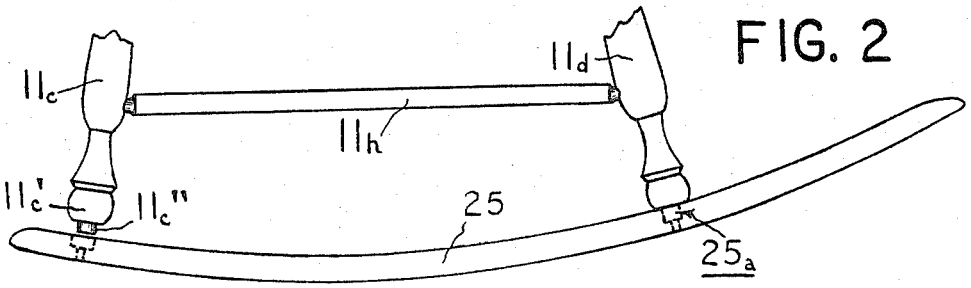
FIG. 2 portrays lower parts of legs of a seat subassembly such as that of FIG. 1, together with a rocker runner fitted therewith.
Figure 3:
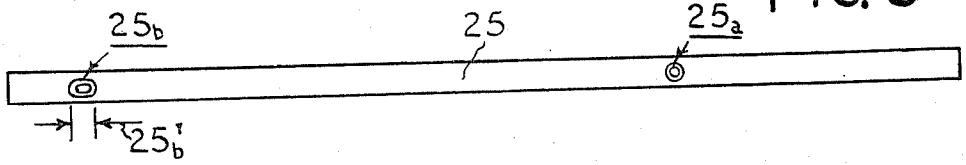
FIG. 3 views the runner of FIG. 2 from above.

Rocker runners, such as runner 25 (FIGS. 2 and 3), are affixed to the lower ends of legs $\mathbf{11}_c$–$\mathbf{11}_d$ and $\mathbf{11}_a$–$\mathbf{11}_b$ to complete the assembly of the chair as a rocker. Tenon-like reductions of the size of the leg ends are preferred, such that one, $\mathbf{11}_d'$, may fit rather closely within a similarly-proportioned opening $\mathbf{25}_a$ appearing at the top of runner 25 and the other, $\mathbf{11}_c''$, may find its way into some part of an elongated top opening $\mathbf{25}_b$ while the more massive leg end $\mathbf{11}_c'$ nevertheless covers the unfilled parts of the latter opening. The elongation of top opening $\mathbf{25}_b'$, in the longitudinal direction of the runner, is therefore not in excess of about the radius of the massive leg end $\mathbf{11}_c'$ plus the radius of the tenon $\mathbf{11}_c''$, to satisfy that covering condition and yet allow the needed longitudinal play. Such play accommodates advantageously the dimensional variations or tolerances which must be expected in the spread between ends of legs such as $\mathbf{11}_c$ and $\mathbf{11}_d$ when the prefabrication involves the necessarily imprecise dimensioning common to woodworking of even very skilled craftsmen. The assembler need only insert one leg tenon, such as $\mathbf{11}_d'$ into its cooperating runner mortise $\mathbf{25}_a$ and can then be assured that the other, $\mathbf{11}_c''$, will fit within elongated mortise $\mathbf{25}_b$ without undue forcing such as might otherwise cause leg or runner splitting or other damage. Bolts, preferable also of the Allen-head type such as 17, may then be passed through the lower and more constricted portions of the runner openings and threaded into the legs or threaded inserts, such as 18, in those legs to complete the secure fastenings of the runners.

The marginal seat parts $\mathbf{15}_B$–$\mathbf{15}_D$ are preferable contoured along their top surfaces so as to blend smoothly and without interruption or irregularity with the contouring of the top surfaces of the central seat part $\mathbf{15}_A$. Although the margins 19, 20 and 21 have been shown as substantially linear, they may instead be curved to follow a shaping such as that of the seat relief sculpting 26 (FIGS. 4 and 5), for example, and may thereby be rendered even less inconspicuous. The side seat parts $\mathbf{15}_B$ and $\mathbf{15}_C$ are preferably longer than the center seat margins 19 and 21 which they abut, so that their rear extensions will close about the two ends of rear seat part $\mathbf{15}_D$ disposed between them; however, the latter part may in another embodiment span fully the rear of the combined seat parts $\mathbf{15}_B$, $\mathbf{15}_A$ and $\mathbf{15}_C$. Fasteners other than those specifically described may be employed with useful results, and glueing may also be introduced by the assembler, if desired, although not commonly essential. Ornamentation and finishing, by way of such things as post-capping threaded knobs 27 (FIG. 1) and the like may of course be added to complete the quality styling of the improved-appearance knock-down item.

It should therefore be understood that the specific embodiments and practices shown and described herein have been presented by way of disclosure, rather than limitation, and that various modifications, combinations and substitutions may be effected by those skilled in the art without departure in spirit or scope from this invention in its broader aspects and as set forth in the appended claims.

What I claim as new and desire to secure by Letters Patent of the United States is:

1. A knock-down chair comprising a first prefabricated sub-assembly including a central seat part having four depending legs fixed therewith, said central seat part lacking side and rear marginal portions needed to complete the full side and rear lateral expanse of the seat for the chair, second and third prefabricated sub-assemblies each including arm rest means respectively fixed with and extending above right and left marginal seat parts which are proportioned to abut with the right and left sides of said central seat part and to complete the right and left side lateral expanse of the seat, a fourth prefabricated sub-assembly including back rest means fixed with and extending above a rear marginal seat part proportioned to abut with the rear of said central seat part and to complete the rear lateral expanse of the seat, and means for securing said marginal seat parts in abutted relationship with said marginal portions of said central seat part.

2. A knock-down chair as set forth in claim 1 wherein said securing means includes elongated bolts, said marginal seat parts having openings extending laterally therethrough and proportioned to receive and hold one of said bolts, and said central seat part having laterally-extending receptacles disposed to receive and hold said bolts.

3. A knock-down chair as set forth in claim 2 wherein said securing means further includes elongated dowels, at least some of said marginal seat parts and the cooperating side and rear margins of said central seat part having lateral openings recessed therein and proportioned and aligned to receive and hold and be held by said dowels cooperatively, said openings being recessed into said marginal seat parts from inner margins thereof and being blind, whereby upon assembly said dowels strongly resist forces in shear tending to separate said seat parts and also remain concealed.

4. A knock-down chair as set forth in claim 3 wherein said dowels are prefabricated fixedly with said central seat part and project laterally outwardly therefrom to engage and aid in holding said marginal seat parts during assembly.

5. A knock-down chair as set forth in claim 1 wherein said second and third prefabricated sub-assemblies each further includes an elongated upstanding support for said back rest means fixed near the rear thereof, and means for securing said back rest means with the supports of said second and third sub-assemblies.

6. A knock-down chair as set forth in claim 5 further comprising dowels prefabricated fixedly with said central seat part along said side margin thereof and projecting laterally outwardly therefrom to engage and fit closely within aligned accommodating blind openings recessed into said right and left marginal seat parts from the inner edges thereof.

7. A knock-down chair as set forth in claim 1 wherein said right and left marginal seat parts extend rearwardly beyond right and left margins of said central seat part when abutted therewith, and wherein said rear marginal seat part extends and fits between the rear extensions of said right and left marginal seat parts when abutted with the rear margin of said central seat part.

8. A knock-down chair as set forth in claim 7 wherein said margins of said central seat part and the abutting surfaces of said right and left and rear marginal seat parts are substantially linear.

9. A knock-down chair as set forth in claim 1 wherein the lower ends of said legs are formed as tenons of cross-section reduced in relation to the wider leg portions immediately thereabove, and further comprising a pair of elongated rocker runners each having a pair of uniformly-spaced mortise-type openings recessed into the top thereof, said openings being spaced about the same as the spacing between a front-and-rear pair of said legs along a side of said central seat part, one of said pair of openings fitting closely about one of said tenons of one of said pair of legs and the other being of elongated configuration and elongated in the direction of elongation of said runner, said elongated recess being of length not greater than about the combined lengths in the same direction of half the cooperating tenon and half the leg portion immediately thereabove, whereby a runner may be affixed to a pair of said legs by fitting one of said tenons snugly into the close-fitting opening thereof and inserting the other tenon into the elongated opening, the latter being thereby closed by the wider leg portion above the said other tenon, and bolt means for fastening said runners with lower ends of said legs through restricted openings communicating with said mortise-type openings from below.

10. A knock-down chair comprising a first sub-assembly including a central seat part having four depending legs fixed therewith, said central seat part lacking side and rear marginal portions needed to complete the full side and rear lateral expanse of an exposed uncovered seat for the chair, second and third sub-assemblies each including an upstanding support fixed with and extending above right and left marginal seat parts proportioned to abut with the right and left sides of said central seat part and to complete the right and left side lateral expanse of the seat, a fourth prefabricated sub-assembly including back rest means fixed with and extending above a rear marginal seat part proportioned to abut with the rear of said central seat part and to complete the rear lateral expanse of the seat, laterally-extending means for securing said marginal seat parts in abutted relationship with said marginal portions of said central seat part and strongly resisting separations therebetween in shear, and means for securing said back rest means with said upstanding supports of said second and third sub-assemblies.

11. A knock-down rocking chair comprising a sub-assembly including a seat part having four depending legs fixed therewith, the lower ends of said legs being formed as tenons of cross-section reduced in relation to wider leg portions immediately thereabove, and further comprising a pair of elongated rocker runners each having a pair of uniformly-spaced mortise-type openings recessed into the top thereof, said openings being spaced about the same as the spacing between a front-and-rear pair of said legs along a side of said seat part, one of said pair of openings fitting closely about one of said tenons of one of said pair of legs and the other being of elongated configuration and elongated in the direction of elongation of said runner, said elongated recess being of length not greater than about the combined lengths in the same direction of half the cooperating tenon and half the leg portion immediately thereabove, whereby a runner may be affixed to a pair of said legs by fitting one of said tenons snugly into the close-fitting opening thereof and inserting the other tenon into the elongated opening, the latter being thereby closed by the wider leg portion above the said other tenon, and bolt means for fastening said runners with lower ends of said legs through restricted openings communicating with said mortise-type openings from below.

* * * * *